US009016603B2

(12) United States Patent
Holtman

(10) Patent No.: US 9,016,603 B2
(45) Date of Patent: Apr. 28, 2015

(54) FUEL INJECTOR

(71) Applicant: Caterpillar Inc., Peoria, IL (US)

(72) Inventor: Richard Holtman, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 173 days.

(21) Appl. No.: 13/747,589

(22) Filed: Jan. 23, 2013

(65) Prior Publication Data

US 2014/0203112 A1 Jul. 24, 2014

(51) Int. Cl.

| | |
|---|---|
| ***B05B 1/30*** | (2006.01) |
| ***F02M 41/16*** | (2006.01) |
| ***F02M 61/20*** | (2006.01) |
| ***F02D 1/06*** | (2006.01) |
| ***F02M 51/00*** | (2006.01) |
| ***F02M 63/00*** | (2006.01) |
| ***F02M 47/02*** | (2006.01) |

(52) U.S. Cl.

CPC ..... *F02M 63/0022* (2013.01); *F02M 47/027* (2013.01); *F02M 63/0075* (2013.01)

(58) Field of Classification Search

CPC ..... F02M 63/0022; F02M 63/0075; F02M 47/027; F02M 51/066

USPC ..... 239/5, 86–89, 91, 95, 96, 533.2, 533.9, 239/533.11, 584, 585.1, 585.3–585.5; 251/129.01, 129.15, 129.16, 129.19, 251/129.21, 127; 123/472

See application file for complete search history.

(56) References Cited

U.S. PATENT DOCUMENTS

| | | | | |
|---|---|---|---|---|
| 4,966,119 | A | 10/1990 | Mitsuyasu et al. | |
| 6,056,264 | A * | 5/2000 | Benson et al. | 251/129.19 |
| 7,156,368 | B2 * | 1/2007 | Lucas et al. | 251/129.19 |
| 7,273,186 | B2 * | 9/2007 | Kubo et al. | 239/88 |
| 8,690,075 | B2 * | 4/2014 | Mahmood et al. | 239/5 |
| 2010/0176223 | A1 * | 7/2010 | Venkataraghavan et al. | 239/585.1 |
| 2010/0186719 | A1 * | 7/2010 | Venkataraghavan et al. | 123/472 |
| 2011/0168813 | A1 | 7/2011 | Bunni et al. | |
| 2012/0291753 | A1 * | 11/2012 | Hefler et al. | 123/456 |
| 2012/0325926 | A1 * | 12/2012 | Moore et al. | 239/5 |

FOREIGN PATENT DOCUMENTS

| | | | |
|---|---|---|---|
| CN | 101251067 | B | 8/2008 |
| DE | 102009000284 | A1 | 7/2010 |
| DE | 102010030403 | A1 | 12/2011 |
| DE | 102010031392 | A1 | 1/2012 |
| DE | 102010063183 | A1 | 6/2012 |

* cited by examiner

*Primary Examiner* — Len Tran
*Assistant Examiner* — Cody Lieuwen

(57) ABSTRACT

A common rail fuel injector includes a control valve member unattached to, but trapped between, a push pin and a seat of an injector body. The push pin has a head that includes a contact surface and a crown that includes a stop surface. An air gap surface of an armature is located between a top of the head and the stop surface of the crown when the contact surface of the push pin is in contact with the armature. The stop surface of the crown is located between an air gap plane of a stator assembly and the air gap surface of the armature. The push pin, the armature and the control valve member are movable among a rest configuration, an injection configuration, and an over travel configuration.

20 Claims, 2 Drawing Sheets

FUEL INJECTOR

TECHNICAL FIELD

The present disclosure relates generally to fuel injectors, and more particularly to an advanced combination of features for a next generation of common rail fuel injector.

BACKGROUND

Common rail fuel systems for compression ignition engines typically utilize individual fuel injectors that are positioned for direct injection of fuel into individual engine cylinders. Although piezo's have been considered, each of the fuel injectors may typically be controlled with a solenoid actuator that controls pressure in a control chamber to allow a direct operated check to move between open and closed positions. U.S. Pat. No. 7,273,186 shows an example of a common rail fuel injector. Although many different common rail fuel injectors have performed well for years, there remains challenges with regard to reducing costs while improving performance and adopting features that allow the fuel injectors to be mass produced while still producing consistent results.

The present disclosure is directed toward one or more of the problems set forth above.

SUMMARY

A fuel injector according to the present disclosure includes an injector body that defines a common rail inlet, a nozzle outlet and a drain outlet. A solenoid actuator is disposed in the injector body, and includes an armature that moves with respect to a stator assembly, which includes a pole piece and a stop pin that are flush at an air gap plane. A control chamber is disposed in the injector body. A check valve member has a closing hydraulic surface exposed to fluid pressure in the control chamber, and is movable between a closed position blocking the nozzle outlet and an open position fluidly connecting the common rail inlet to the nozzle outlet. A control valve member is unattached to, but trapped between a push pin and a seat of the injector body. The control valve member is movable between a closed position in contact with the seat, and an open position out of contact with the seat to fluidly connect the control chamber to the drain outlet. The push pin has a head that includes a contact surface and a crown that includes a stop surface. An air gap surface of the armature is located between a top of the head and the stop surface of the crown when the contact surface of the push pin is in contact with the armature. The stop surface of the crown is located between the air gap plane and the air gap surface of the armature. The push pin, the armature and the control valve member are movable among a rest configuration, an injection configuration and an over travel configuration. The contact surface of the push pin is out of contact with the armature in the over travel configuration.

DETAILED DESCRIPTION

Figure 1:
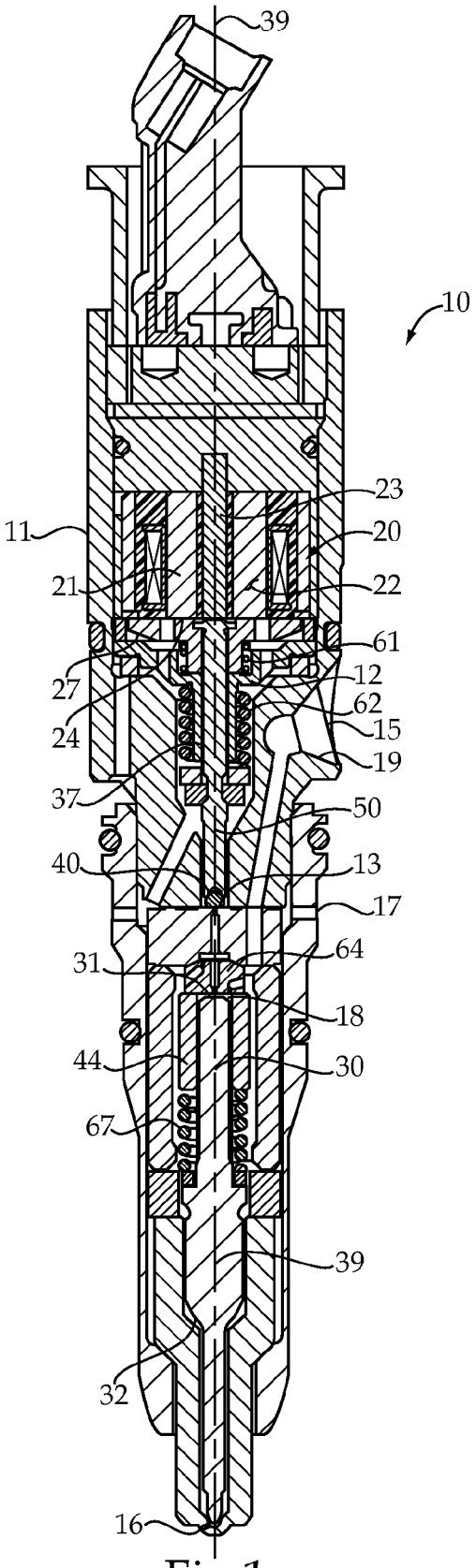
FIG. 1 is a front sectioned diagrammatic view of a fuel injector according to the present disclosure.
Figure 2:
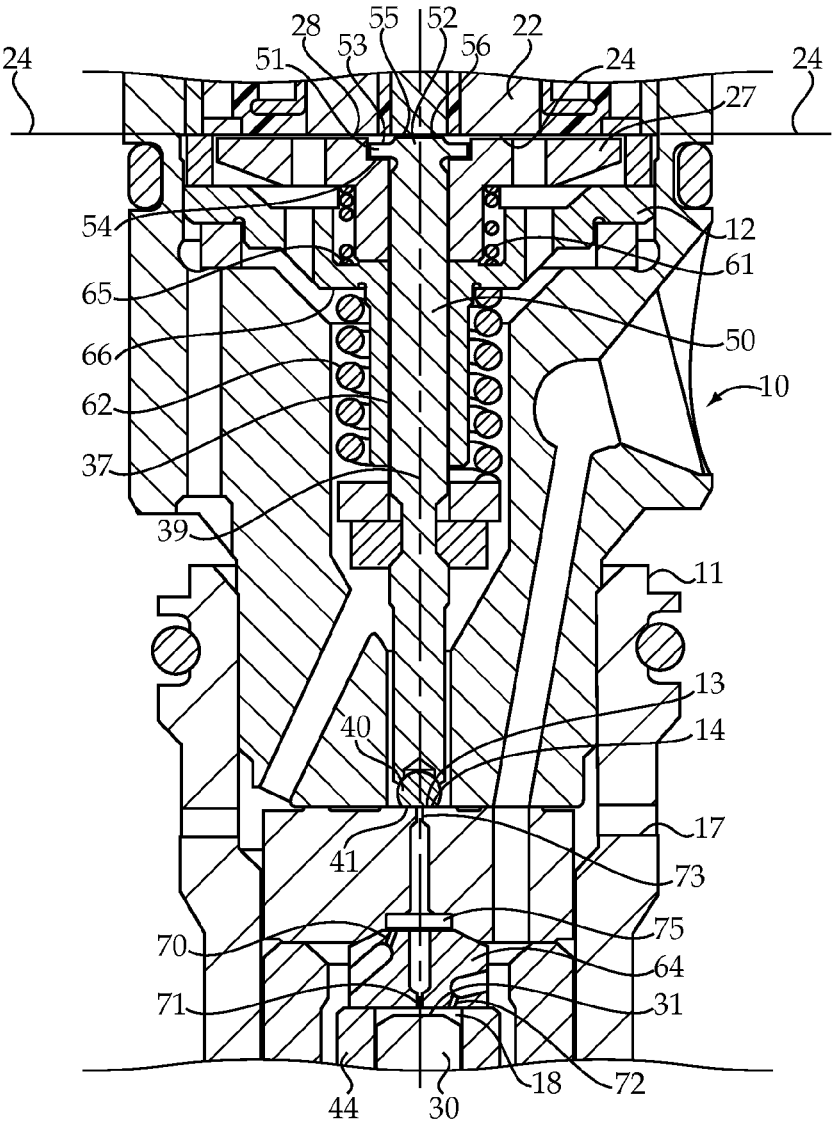
FIG. 2 is an enlarged sectioned diagrammatic view of the control portion of the fuel injector of FIG. 1.
Figure 3:
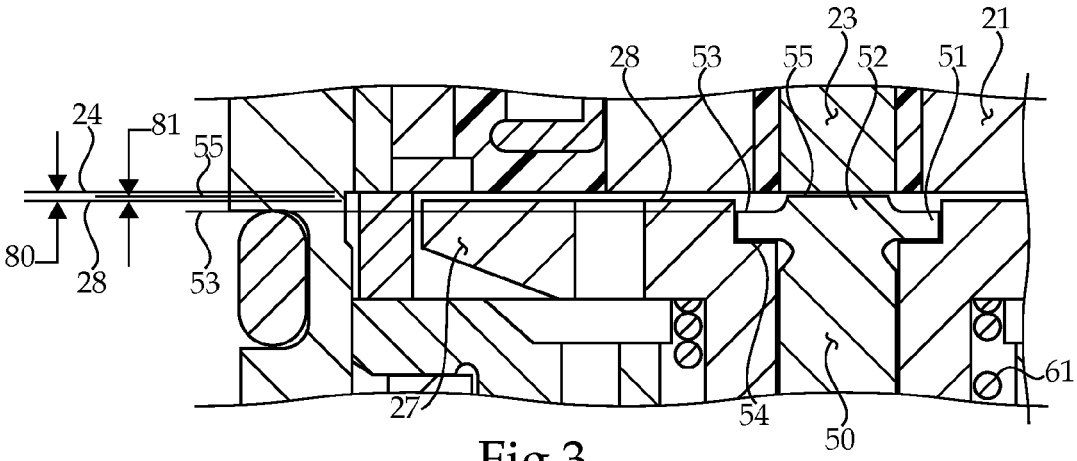
FIG. 3 is a further enlarged sectioned diagrammatic view of a portion of the electrical actuator from the fuel injector of FIGS. 1 and 2.

Referring now to FIGS. 1-3, a fuel injector 10 includes an injector body 11 that defines a common rail inlet 15, a nozzle outlet 16 and a drain outlet 17. The common rail inlet 15 may take the form of a conical seat 19 to sealingly engage a quill fluidly connected to a common rail in a known manner. A solenoid actuator 20 is disposed in the injector body 11, and includes an armature 27 that moves with respect to a stator assembly 21. Stator assembly 21 includes a pole piece 22 and a stop pin 23 that are flush at an air gap plane 24. Stator assembly 21 may be substantially free of empty space between pole piece 22 and a centerline 39. In addition, stop pin 23 may be surrounded by, but radially spaced apart from, the pole piece 22, such as by a plastic filler material that may also serve to magnetically isolate the stop pin 23 from pole piece 22. The solenoid actuator 20 is operably coupled to a check valve member 30 that includes a closing hydraulic surface 31 exposed to fluid pressure in a control chamber 18 that is disposed in the injector body 11. The check valve member 30 is movable between a closed position (as shown) blocking the nozzle outlet 16, and an open position fluidly connecting the common rail inlet 15 to the nozzle outlet 16. The check valve member 30 includes an opening hydraulic surface 32 exposed to fluid pressure in the common rail inlet 15, which corresponds to pressure in a common rail (not shown).

A control valve member 40 is unattached to, but trapped between, a push pin 50 and a seat 13 of the injector body 11. Control valve member 40 is movable between a closed position (as shown) in contact with seat 13, and an open position out of contact with seat 13 to fluidly connect the control chamber 18 to the drain outlet 17. The push pin 50 has a head 51 that includes a contact surface 54, and a crown 52 that includes a stop surface 55. Although somewhat apparent, the stop surface 55 may have an area that is smaller than an area of contact surface 54. Those skilled in the art will appreciate that the respective areas relate to the area where armature 27 contacts push pin 50 (contact surface 54) and the area (stop surface 55) that stop pin 23 comes in contact push pin 50 when solenoid actuator 22 in energized. The push pin 50 interacts at one end with armature 27 and at its opposite end with control valve member 40 to facilitate movement of control valve member 40 between its closed and open positions responsive to de-energizing and energizing solenoid actuator 20, respectively. An air gap surface 28 of armature 27 is located between a top 53 of head 51 and the stop surface 55 of crown 52 when the contact surface 54 of push pin 50 is in contact with armature 27, as shown. The stop surface 55 of the crown 52 is located between the air gap plane 24 of stator assembly 21 and the air gap surface 28 of armature 27. A majority 56 of the stop surface 55 is located radially inward from the contact surface 54 with respect to centerline 39. In the illustrated embodiment, the entire stop surface 55 is located radially inward from the contact surface 54. The push pin 50, the armature 27 and the control valve member 40 are movable among a rest configuration (as shown), an injection configuration and an over travel configuration. The injection configuration corresponds to control valve member 40 being out of contact with seat 13, and the stop surface 55 of push pin 50 being in contact with stop pin 23. The over travel configuration may be characterized by the contact surface 54 of the push pin 50 being out of contact with the armature 27, which may occur briefly after de-energizing solenoid actuator 20 when control valve member 40 impacts seat 13.

The push pin 50 may have a guide interaction 37 with a guide piece 12 of injector body 11. A guide interaction according to the present disclosure means that the moving component (e.g., push pin 50) has a close diametrical clearance with the stationary piece (e.g., guide piece 12). A first spring 61 and second spring 62 may be positioned on opposite sides of the guide piece 12. The first spring 61 being operably positioned to bias the armature 27 toward contact with the contact surface 54 of push pin 50. The second spring 62 may be operably positioned to bias the control valve member 40 toward its closed position in contact with seat 13. First spring 61 may be weaker than second spring 62 and is sometimes referred to as an over travel spring. First spring 61 is located on side 65 of guide piece 12, whereas second spring 62 is located on side 66 of guide piece 12. Although not necessary, in the illustrated embodiment, seat 13 is a flat seat 14, and the control valve member 40 has a planer surface 41 in contact with flat seat 14 at its closed position. Control valve member 40 may, but need not necessarily be formed from a nonmetallic material, such as a ceramic. As shown in the Figs., the push pin 50 is entirely located on an opposite side of the air gap plane 24 from the stop pin 23.

Although other structures would fall within the intended scope of the present disclosure, the control chamber 18 is shown partially defined by a sleeve 44 and an orifice piece 64. A biasing spring 67 may be operably positioned to simultaneously bias the sleeve 44 into contact with the orifice piece 64, and bias the check valve member 30 toward its downward closed position, as shown.

When fuel injector 10 is in the injection configuration, the common rail inlet 15 is fluidly connected to the drain outlet 17 through an F orifice 70, an A orifice 71, a Z orifice 72 and an E orifice 73. The F orifice 70 may assist in more abruptly ending injection events by fluidly connecting control chamber 18 to the high pressure in common rail inlet 15 at the end of an injection event. This fluid connection may include the F orifice 70, an intermediate chamber 75 and the A orifice 71 in parallel with the Z orifice 72. Together, the F orifice and the E orifice 73 may be sized to influence the rate at which the needle valve member 30 lifts from its closed position to its open position by influencing the rate at which fuel escapes to drain outlet 17 past control valve member 40. The F orifice 70 and the Z orifice 72 are fluidly in parallel. Those skilled in the art will appreciate that the F orifice could be omitted altogether without from departing from the present disclosure. The flow restriction provided by the E orifice 73 could also be omitted such that a flow passage existed but no flow restriction E orifice were included without departing from the present disclosure. As used in this disclosure, an orifice means a sized flow restriction.

Referring specifically to FIG. 3, the relationships between the air gap plane 24 of stator assembly 21, the air gap surface 28 of armature 27, the top 53 of head 51 and the stop surface 55 of push pin 50 to the initial air gap 80 and final air gap 81 of solenoid actuator 20 are illustrated. Those skilled in the art will appreciate that the armature 27 moves from an initial air gap 80 to a final air gap 81 separation from stator assembly 21 when the solenoid actuator 20 is energized. The setting of final air gap 81 may be facilitated by the distance between contact surface 54 and stop surface 55 so that the stop surface 55 is positioned the final air gap distance 81 above the air gap surface 28 of armature 27. By locating the top of head 53 below the air gap surface 28, interaction between head 51 and stator assembly 21 is avoided. In addition, by separating the structural features of the push pin 50 so that the crown 52 interacts with stop pin 23 and the head 51 interacts with armature 27, cross coupling issues can be avoided.

INDUSTRIAL APPLICABILITY

The present disclosure finds general applicability to fuel injectors for common rail fueling applications. The present disclosure finds specific application to common rail fuel injectors for compression ignition engines.

Between injection events, fuel injector 10 will be in a rest configuration, as shown. When in the rest configuration, solenoid actuator 20 is de-energized, armature 27 is in contact at contact surface 54 with push pin 50, and control valve member 40 is in its closed position in contact with flat seat 14. In addition, in the rest configuration the check valve member 30 is in its downward closed position blocking nozzle outlet 16. Also in the rest configuration the pressure in control chamber 18 is high such that rail pressure may be acting on both the closing hydraulic surface 31 and the opening hydraulic surface 32. An injection event is initiated by energizing solenoid actuator 20. When this occurs, the pole piece 22 magnetically attracts the armature 27. As the armature 27 begins moving toward stator assembly 21, push pin 50 is lifted to allow the high pressure in control chamber 18 to push control valve member 40 off of flat seat 14 to fluidly connect control chamber 18 to the low pressure of drain outlet 17. The motion of armature 27 will stop when stop surface 55 of crown 52 contacts stop pin 23. When pressure in control chamber 18 drops sufficiently, the high pressure acting on opening hydraulic surface 32 pushes check valve member 30 upward against the action of biasing spring 67 to commence an injection event. When fuel injector 10 is in the injection configuration, check valve member 30 is in its upward open position, control valve member 40 is in its open position out of contact with flat seat 14 and push pin 50 is in contact with stop pin 23 and armature 27, with armature 27 being at a final air gap distance 81 away from stator assembly 21. Toward the end of an injection event, solenoid actuator 20 will be de-energized. Second spring 62 will begin moving push pin 50 downward. This movement will be transferred to movement of armature 27 via the interaction between contact surface 54 of push pin 50 and armature 27. When control valve member 40 comes in contact with flat seat 14, push pin 50 will abruptly stop. However, the armature may continue moving such that contact surface 54 of push pin 50 briefly moves out of contact with armature 27, which corresponds to the over travel configuration. When control valve member 40 resumes its closed position in contact with flat seat 14, the pressure in control chamber 18 abruptly arises, allowing biasing spring 67 to push check valve member 30 back downward toward its closed position to end the injection event. A short time after the over travel configuration, first spring 61 will urge armature 27 back into contact with push pin, returning the components to the rest configuration for a subsequent injection event.

Fuel injector 10 includes several subtle features that help facilitate reduced cost, reduced part count, and mass production with consistent performance from different fuel injectors even in the face of inevitable slight geometric tolerances in the various components that make up fuel injector 10. Among the features are the control valve member 40 being unattached to push pin 50, which is also unattached to armature 27. The spherical interaction between control valve member 40 and push pin 50 along with the utilization of a flat seat 14 helps to avoid perpendicularity issues and also provides a self-centering feature to get good sealing contact at flat seat 14. By locating the armature interaction features of push pin 50 in head 51 which is radially separated from the crown 52 that interacts with stop pin 23, cross coupling compromises can also be avoided. By providing a structure in which the distance along centerline 39 between contact surface 54 and stop surface 55 partially defines the final air gap distance 81, push pin 50 may be a category part that is matched to an armature 27, which may also be a category part, to consistently manufacture fuel injectors with almost identical initial and final air gap dimensions, along with consistent performance provided by the same. In addition, by providing a stator assembly with a pole piece 22 and stop pin 23 that are flush at an air gap plane 24, the stator assembly 21 can be separated from geometrical tolerance and interaction features that make up the air gap distances. By allowing armature 27 to move to an air travel configuration with respect to push pin 50, the likelihood of control valve member 40 bouncing off of flat seat 14 are reduced, thus reducing the likelihood of small undesirable secondary injection events. By including F and E orifices, some measures may be taken to differentiate the rate at which the check valve member 30 moves upward towards its open position versus moving downward toward its closed position to incrementally improve performance over prior art fuel injectors.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel injector comprising:

an injector body defining a common rail inlet, a nozzle outlet and a drain outlet;

a solenoid actuator disposed in the injector body and including an armature that moves with respect to a stator assembly, which includes a pole piece and a stop pin that are flush at an air gap plane;

a control chamber disposed in the injector body;

a check valve member with a closing hydraulic surface exposed to fluid pressure in the control chamber, and being movable between a closed position blocking the nozzle outlet and an open position fluidly connecting the common rail inlet to the nozzle outlet; and a control valve member unattached to, but trapped between, a push pin and a seat of the injector body, and being movable between a closed position in contact with the seat, and an open position out of contact with the seat to fluidly connect the control chamber to the drain outlet;

the push pin has a head that includes a contact surface below a top of the head, and a crown that includes a stop surface, the contact surface being an undersurface of the head and configured to contact the armature in a rest configuration, the top being below an air gap surface of the armature;

the air gap surface of the armature is located between the top of the head and the stop surface of the crown when the contact surface of the push pin is in contact with the armature;

the stop surface of the crown is located between the air gap plane and the air gap surface of the armature; and the push pin, the armature and the control valve member being movable among the rest configuration, an injection configuration and an over travel configuration, and the contact surface of the push pin being out of contact with the armature in the over travel configuration.

2. The fuel injector of claim 1 wherein a majority of the stop surface is located radially inward from the contact surface, with respect to a centerline.

3. The fuel injector of claim 1 wherein the push pin has a guide interaction with a guide piece of the injector body;

a first spring and a second spring positioned on opposite sides of the guide piece;

the first spring biasing the armature toward contact with the contact surface of the push pin, and the second spring biasing the control valve member toward the closed position.

4. The fuel injector of claim 3 wherein a majority of the stop surface is located radially inward from the contact surface, with respect to a centerline.

5. The fuel injector of claim 1 wherein the stop pin is surrounded by, but radially spaced apart from, the pole piece.

6. The fuel injector of claim 1 wherein the push pin is entirely located on an opposite side of the air gap plane from the stop pin.

7. The fuel injector of claim 1 wherein the seat is a flat seat; and the control valve member has a planar surface in contact with the flat seat at the closed position.

8. The fuel injector of claim 1 wherein the control chamber is partially defined by a sleeve and an orifice piece; and a biasing spring operably positioned to simultaneously bias the sleeve into contact with the orifice piece, and bias the check valve member toward the closed position.

9. The fuel injector of claim 1 wherein the common rail inlet is fluidly connected to the drain outlet through an F orifice, an A orifice, a Z orifice and an E orifice in the injection configuration; and the F orifice and the Z orifice are fluidly in parallel.

10. The fuel injector of claim 1 wherein the stop pin is surrounded by, but radially spaced apart from, the pole piece; and wherein the push pin is entirely located on an opposite side of the air gap plane from the stop pin.

11. The fuel injector of claim 1 wherein the stop surface is out of contact with the stop pin, the contact surface is out of contact with the armature and the control valve member is at the closed position, in the over travel configuration;

the stop surface is in contact with the stop pin, the contact surface is in contact with the armature and the control valve member is at the open position, in the injection configuration; and the stop surface is out of contact with the stop pin, the contact surface is in contact with the armature and the control valve member is at the closed position, in the rest configuration.

12. The fuel injector of claim 11 wherein the push pin has the head that includes the contact surface and the crown that includes the stop surface; and a majority of the stop surface being located radially inward from the contact surface, with respect to the centerline.

13. The fuel injector of claim 12 wherein the push pin has a guide interaction with a guide piece of the injector body;

a first spring and a second spring positioned on opposite sides of the guide piece;

the first spring biasing the armature toward contact with the contact surface of the push pin, and the second spring biasing the control valve member toward the closed position.

14. The fuel injector of claim 13 wherein the stop pin is surrounded by, but radially spaced apart from, the pole piece.

15. The fuel injector of claim 14 wherein the push pin is entirely located on an opposite side of the air gap plane from the stop pin.

16. The fuel injector of claim 15 wherein the seat is a flat seat; and the control valve member has a planar surface in contact with the flat seat at the closed position.

17. The fuel injector of claim 16 wherein the control chamber is partially defined by a sleeve and an orifice piece; and a biasing spring operably positioned to simultaneously bias the sleeve into contact with the orifice piece, and bias the check valve member toward the closed position.

18. The fuel injector of claim 17 wherein the common rail inlet is fluidly connected to the drain outlet through an F orifice, an A orifice, a Z orifice and an E orifice in the injection configuration; and the F orifice and the Z orifice are fluidly in parallel.

19. The fuel injector of claim 13 wherein an area of the stop surface is smaller than an area of the contact surface.

20. The fuel injector of claim 1, wherein an area of the stop surface is smaller than a cross-sectional area of the stop pin at the air gap plane.

* * * * *